United States Patent [19]

Schilo et al.

[11] Patent Number: 4,943,481

[45] Date of Patent: Jul. 24, 1990

[54] POLYETHER IMIDE FIBERS

[75] Inventors: Diederich Schilo, Klingenberg-Rollfeld; Willi Birkenfeld, Obernburg, both of Fed. Rep. of Germany

[73] Assignee: Akzo N.V., Arnhem, Netherlands

[21] Appl. No.: 197,389

[22] Filed: May 23, 1988

[30] Foreign Application Priority Data

May 21, 1987 [DE] Fed. Rep. of Germany ..... 3717055

[51] Int. Cl.[5] ..... D02G 3/00

[52] U.S. Cl. ..... 428/373; 428/364; 428/374; 428/224

[58] Field of Search ..... 428/364, 373, 374, 375, 428/395, 394

[56] References Cited

U.S. PATENT DOCUMENTS 4,163,030 7/1979 Banucci et al. ..... 428/458 X
4,299,787 11/1981 Gagliani ..... 264/41
4,370,290 1/1983 Makino et al. ..... 264/184
4,728,698 3/1988 Isayev et al. ..... 525/434 X
4,770,915 9/1988 Nakagawa et al. ..... 428/375 X
4,835,047 5/1989 Isayev et al. ..... 525/436

FOREIGN PATENT DOCUMENTS 1038738 8/1966 United Kingdom .
2025311 1/1980 United Kingdom .

*Primary Examiner*—Lorraine T. Kendell
*Attorney, Agent, or Firm*—Oliff & Berridge

[57] ABSTRACT

Melt-spun polyether imide fibers are disclosed wherein the granules are brought to a moisture content of below 0.05%, the melt is extruded from nozzles at a temperature between 300° and 440° C., and the spun fibers are taken up at a speed of up to 2,500 m/min. Fibers produced in this fashion can be stretched up to 1:3 and spin-dyed.

3 Claims, 1 Drawing Sheet

POLYETHER IMIDE FIBERS

TECHNICAL FIELD OF THE INVENTION

The present invention relates to a method of synthesizing polyether imide fibers and polyether imide fibers produced therefrom.

Heretofore, the synthesis of polyether imide fibers (even of polyimide fibers) by melt spinning, otherwise normal for the production of polymer fibers, was thought unfeasible (cf., for example, "P84 - A new synthetic fiber", Weinrotter, Giesser, published in "Man Made Fiber Yearbook" (1986), 16, page 2408). Polyether imide—but only mixed with other polymers—has only been used for the extrusion of a film (European Patent No. A 160,354).

West German Laid-open Application No. 2,829,811 discloses synthesizing polyether imide fibers by spinning solutions of polyamide acids in an aprotic organic solvent in a spinning bath, after which the freshly spun fibers must be stretched and heattreated to obtain usable textile data.

Polyether imide shapes are also known that are made by injection molding, e.g., spectacle frames, as described in West German Laid-open Application No. 3,429,074. The polyether imide used therein is Ultem® 1000 of General Electric Co. The injection moldability of Ultem 1000 is also mentioned in the Germanlanguage product brochure, "Technische Thermoplaste" (Industrial Thermoplastics), brochure also points out that Ultem® fibers are suitable for making textile fabrics, but no further details are given as to how Ultem® fibers can be synthesized.

An object of the present invention is to provide an economical method for making a high-temperature-resistant polyether imide fiber that can be processed further on textile machines in the usual manner. Another object of the invention is to provide such a fiber.

BRIEF SUMMARY OF THE INVENTION

In one aspect, the present invention relates to a process for production of polyether imide fibers comprising drying polyether imide granules to a residual moisture of less than 0.05%, melting and extruding said granules as a melt from nozzles at a temperature between 300° and 440° C., thereby forming fibers, and taking said fibers away from said nozzles.

In another aspect, the present invention relates to a melt-spun polyether imide fiber.

BRIEF DESCRIPTION OF THE DRAWING

The Figure is a schematic illustration of an apparatus which may be used to practice the process of the present invention.

DETAILED DESCRIPTION OF THE PREFERRED EMBODIMENTS

Figure 1:
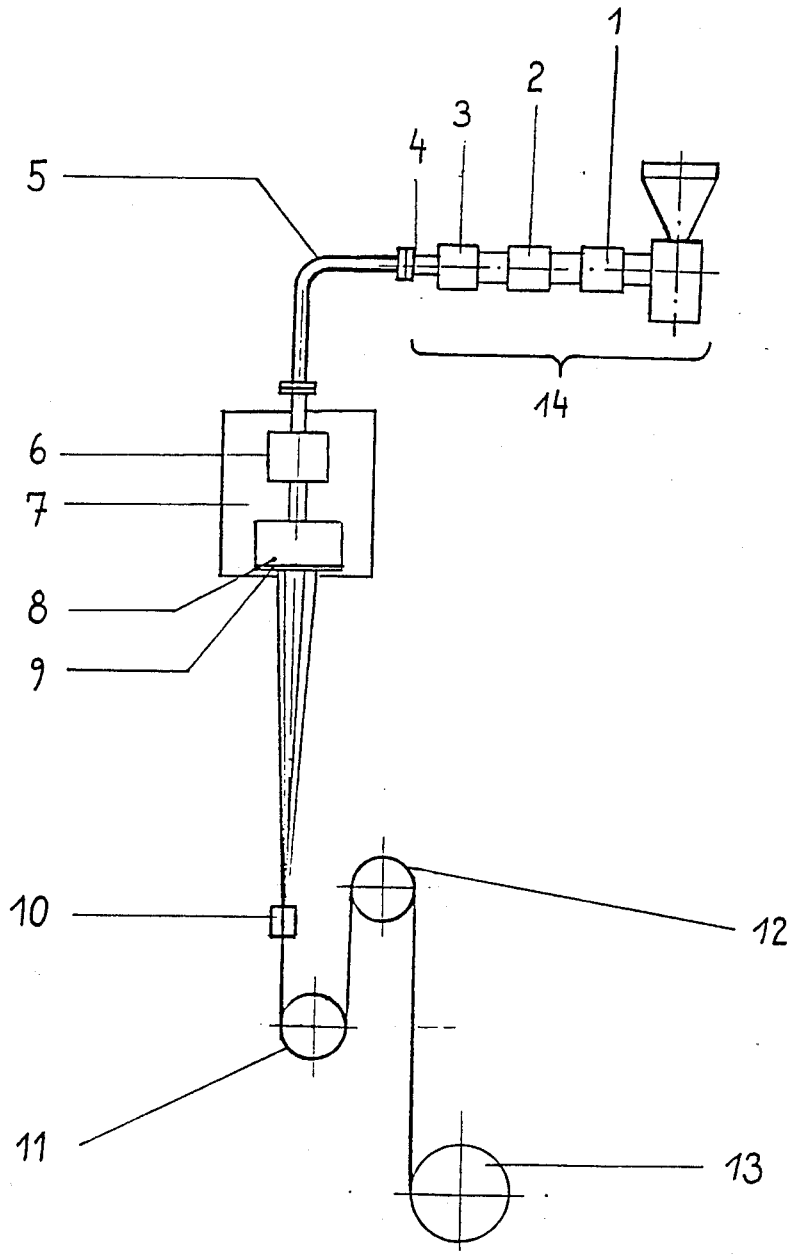

The fibers incorporating the present invention have excellent textile properties, as will be shown in the following Example. They can be further processed, especially stretched and/or textured, on normal textile machines. It is also possible to simultaneously or sequentially stretch-texture yarns made of these fibers without any difficulty. Also, it is possible to use the conventional air-jet blowing (tangling, intermingling, etc.) process.

According to the present invention, "fibers" refer both to continuous filaments and staple fibers. Polyether imide fibers are fibers that contain exclusively, or at least almost exclusively, polyether imide as the polymer.

In the practice of the present invention, polyether imide granules are dried to a residual moisture of less than 0.05%, melted, and extruded through nozzles at from 300° to 400° C., thereby forming fibers. The dried polyether imide granules may be degassed in the extruder during melting. The melt may be fed to the nozzles at a pressure of from 120 to 180 bar.

The polyether imide fibers may be taken up at speeds of up to 2,500 m/min, preferably up to 1,000 m/min, and may be stretched up to 3 times their original unit length.

The polyether imide fiber may additionally be spindyed, and may be extruded as either monofilament or multifilament.

Apparatus which may be used for the melt-spinning process is illustrated in the Figure, in which the numerals have the following designations:

1 extruder zone 1
2 extruder zone 2
3 extruder zone 3
4 melt head
5 melt line
6 melt-spinning pump
7 heating box
8 spinneret
9 spinneret plate
10 spin-finishing device
11 deflector godet 1
12 deflector godet 2
13 winder
14 extruder The invention will be explained in more detail by reference to the Example below, which is intended to be illustrative only and in no way limit the scope of the present invention.

Three continuous polyehter imide fibers were synthesized using the apparatus disclosed in the Figure. The spinning conditions for each sample are set forth in the Table. Textile data of the spun and the stretched fibers are also listed in the Table.

TABLE

| Spinning conditions | Sample A | Sample B | Sample C |
|---|---|---|---|
| Residual moisture content of granules (%) | 0.006 | 0.006 | 0.006 |
| Extruder diameter (mm) | 20 | 20 | 20 |
| Extruder screw speed (rpm) | 42 | 42 | 54 |
| Melt pressure of extruder (bar) | 150 | 95 | 90 |
| Temperatures (°C.): | | | |
| Extruder zone 1 | 350 | 360 | 353 |
| zone 2 | 380 | 380 | 383 |
| zone 3 | 360 | 385 | 378 |
| Melt head | 380 | 376 | 362 |
| Melt line | 400 | 398 | 382 |
| Heating box | 420 | 406 | 382 |
| Nozzle plate | 403 | 389 | 365 |
| Nozzle pressure (bar) | 150 | 140 | 175 |
| Delivery rate (g/min) | 20 | 26.3 | 33 |
| Nozzle | | | |
| Number of discharge openings | 36 | 36 | 36 |
| Diameter of the discharge openings (μm) | 350 | 250 | 250 |
| Take-off speed (m/min) | 350 | 350 | 350 |
| Textile data of unstretched yarn samples | | | |
| Titer (dtex) | 828 | 782 | 839 |
| Strength (cN/tex) | 12.9 | 13.1 | 12.8 |
| Elongation (%) | 132.4 | 136.8 | 131.0 |
| Textile data of stretched yarn samples | | | |
| Titer (dtex) | 450 | 443 | 420 |

TABLE-continued

| Spinning conditions | Sample A | Sample B | Sample C |
|---|---|---|---|
| Strength (cN/tex) | 22.9 | 21.0 | 24.3 |
| Elongation (%) | 17.5 | 16.2 | 16.4 |
| Boiling shrinkage (%) | 7.6 | 7.8 | 7.8 |
| Hot air shrinkage at 190° C. (%) | 13.2 | 13.6 | 13.4 |
| Shrinkage under pressure dying conditions at 125° C. (%) | 10.0 | 10.2 | 10.2 |
| Stretching (l: ) | 2.2 | 2.2 | 2.4 |

The fibers or monofilaments embodying the invention may also contain other polymers, such as, for example, polyethylene terephthalate and/or polyamide. Two-component fibers or two-component monofilaments belong to this group. Two-component monofilaments of polyether imide in the jacket and polyethylene terephthalate in the core are highly suitable, for example, for making hydrolysis-resistant screens or filters, for instance, for paper-making machines.

Fabrics made of fibers incorporating the invention (e.g., woven fabrics, knitted fabrics or non-woven fabrics) have excellent nonflammability with little smoke production, so that they can preferably be used as protective clothing, hot-gas filters or—for example, in the interior of aircraft—as floorings, textile wall coverings, curtains or seat coverings.

We claim:

1. A melt-spun fiber comprising polyether imide and at least one other melt-spinnable polymer selected from the group consisting of polyethylene terephthalate, polyamide, and mixtures thereof.

2. The fiber of claim 1 having a jacket/core bicomponent cross-section.

3. The fiber of claim 2 wherein said jacket consists essentially of polyether imide and said core comprises a polymer selected from the group consisting of polyester and polyamide.

* * * * *